United States Patent [19]

Bock

[11] Patent Number: 4,572,399

[45] Date of Patent: Feb. 25, 1986

[54] PLASTIC CONTAINER HAVING INWARDLY FORMED FLANGE

[76] Inventor: Erik Bock, Ejby Strandvej 3, DK-4070 Kr. Hyllinge, Denmark

[21] Appl. No.: 636,594

[22] Filed: Aug. 1, 1984

[30] Foreign Application Priority Data

Aug. 9, 1983 [DK] Denmark ..... 3631/83

[51] Int. Cl.[4] ..... B65D 39/00

[52] U.S. Cl. ..... 220/307; 150/55

[58] Field of Search ..... 220/306, 307, DIG. 19; 229/43; 150/55

[56] References Cited

U.S. PATENT DOCUMENTS 3,941,300 3/1976 Troth ..... 220/307

4,171,062 10/1979 Allen et al. ..... 220/306

4,307,817 12/1981 Cotraneo ..... 220/307

*Primary Examiner*—George T. Hall

*Attorney, Agent, or Firm*—Murray, Whisenhunt & Ferguson

[57] ABSTRACT

A plastics container has a side wall and a rim portion moulded in one piece with the side wall. The rim portion is joined to the side wall by an integral hinge portion on which it can be folded inwardly of the container. Thereby a container having an inwardly projecting rim or retaining tabs can be readily produced as a one-piece moulding. Preferably, the side wall and rim portion are inwardly concave, whereby the rim portion can be held in its inwards position by forces caused by folding.

16 Claims, 19 Drawing Figures

Figure 1:
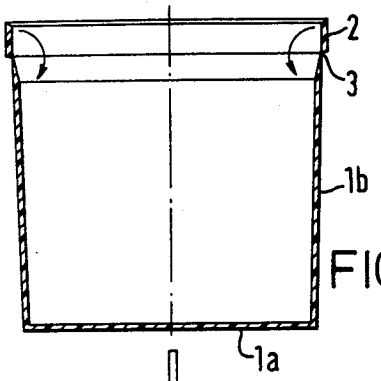

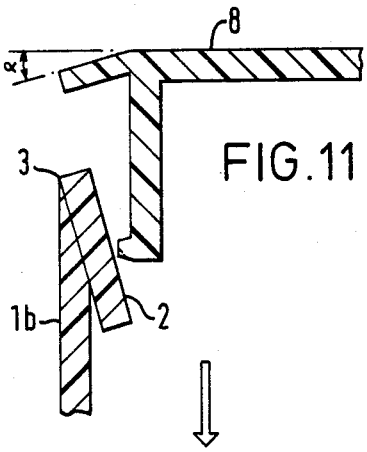
FIG.11
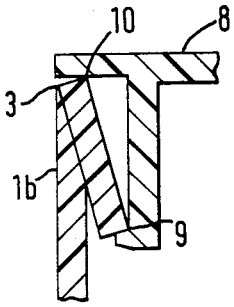
FIG.12
FIG.13
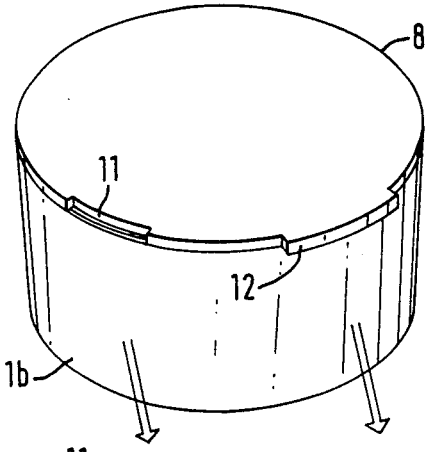
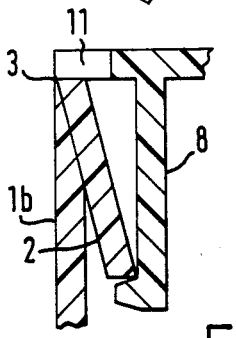
FIG.14
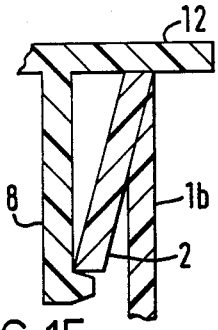
FIG.15

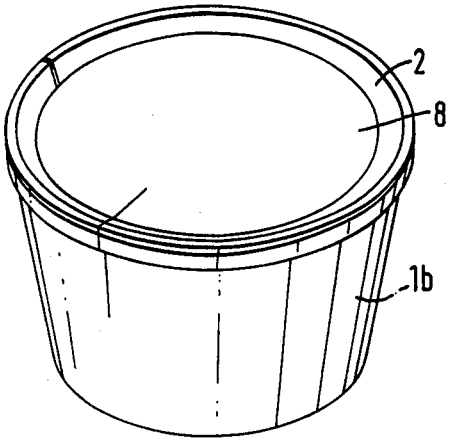
FIG. 16
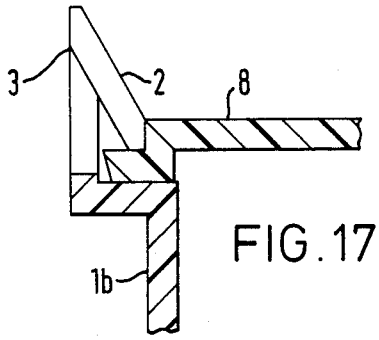
FIG. 17
FIG. 18
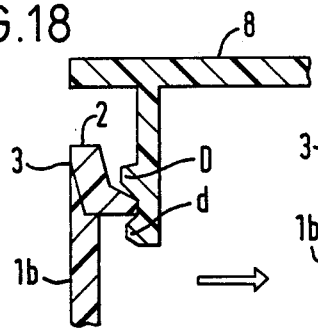
FIG. 19
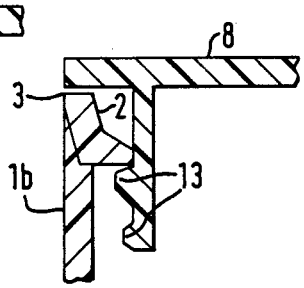

PLASTIC CONTAINER HAVING INWARDLY FORMED FLANGE

DESCRIPTION

This invention is concerned with a plastics container.

It is usually necessary to provide plastics containers with projecting rims, e.g. for reinforcement or for attachment of lids. For technical and economic reasons, it has been normal to design plastics containers with rims projecting outwards. When moulding a container in one piece, it has been necessary to employ a collapsible core in the mould to obtain an inwardly-projecting rim. Moulds with collapsible cores are expensive and cooling is inefficient, thus slowing down the rate of production. It is also known to assemble a separately moulded rim component with a moulded container to provide an inwardly-projecting rim, but the time and expense of production are necessarily greater than for moulding containers in one piece with outwardly-projecting rims.

Outwardly-projecting rims have various disadvantages. The effective utilisation of space during warehousing and distribution is decreased. Lids snapped on to outwardly-projecting rims may push each other off the containers, when the latter are piled together during transportation and the piles move relatively to each other. When the containers are being filled on a filling line, there is a risk of outwardly-projecting rims causing overturning when the containers push against each other.

As well as avoiding or minimising the above disadvantages, inwardly-projecting rims have the advantage that the area available for decoration on the surface of the container may be increased. Also, inwardly-projecting rims help to prevent liquid contents from splashing over when containers are moved from a filling station to a lidding station.

It is an object of the present invention to provide a plastics container which avoids or minimises the disadvantages of outwardly-projecting rims and of collapsible cores and separately moulded rim components.

To this end, the invention provides a plastics container having a side wall and a rim portion moulded in one piece therewith, characterised in that the rim portion is joined to the side wall by an integral hinge portion on which it can be folded inwardly of the container.

Usually, the container will be made by injection moulding. The container opening, at the top of the side wall, may be of any suitable shape, e.g. circular, elliptical or angular or partly of such shape.

Desirably, the hinge portion is of substantially less thickness than the rim portion and side wall.

Preferably, the side wall and rim portion are inwardly concave, whereby the rim portion can be held in its inwards position by forces caused by folding.

The rim portion may extend continuously around the container. Alternatively, there may be a plurality of rim portions spaced apart from one another around the container or a single rim portion may extend for part of the way round the container.

It may sometimes be advantageous to provide at least two co-extensive rim portions connected to each other by an integral hinge portion whereby the coextensive rim portions can be folded inwardly of the container. With such a multi-hinged arrangement, a thicker rim can be obtained.

In addition to acting as a reinforcement, the rim portion may be shaped for releasably securing a lid on the container. For example, it may be shaped with a thread to accept a screw cap and/or with a bead to accept a snap-on lid. In such cases, the rim portion will have been folded inwards prior to lidding.

Said side wall may have an internal recess for supporting said rim portion when folded inwardly. In this way, the hinge may be relieved of load and there is little or no risk of the hinge breaking even if a heavy load is placed on the lid.

In one embodiment of the invention, said side wall has an internal recess so formed that when the rim portion is folded inwardly there is a clearance between the rim portion and an upwardly-directed surface of the recess for accommodating a lid. In this case, the lid is applied before folding the rim portion inwardly.

The rim portion and the inside of said side wall may be provided with complementary profiled formations (e.g. axially extending ribs) which intermesh when the rim portion is folded inwardly. Such a construction will increase the circumferential stiffness of the open container.

The rim portion may have at least one projection which extends upwardly when the rim portion is folded inwardly. Such a projection may prevent a lid from being pressed down into the container when loaded.

In one arrangement according to the invention, the container has a lid, the lid and said rim portion being so formed that, when the rim portion is folded inwardly and the lid is applied, the lid and container engage each other at two axially spaced positions, the distance between the engagement positions on the container being greater than the distance between the engagement positions on the lid before the latter is applied, whereby after the lid has been applied it is axially tensioned.

The container and/or a lid therefore may be provided with at least one recess or projection for opening.

The rim portion and a lid for the container may be so formed that the inwardly-folded rim portion is locked in position by the lid, whereby the rim portion has to be peeled off along said hinge portion to permit removal of the lid. Thus, as well as reinforcing the edge of the container, the rim portion can function as a safety device for the lid in order to improve drop resistance and/or as a pilfer-evident closure.

The container or a lid therefore may have two axially spaced snap beads of different sizes, the lower bead giving less resistance to opening and closing.

The invention further provides a container as hereinbefore defined wherein said rim portion is inwardly concave and has been folded inwards and is held in its inwards position by forces caused by folding and/or, particularly where the rim portion is straight, e.g. in a square container, wherein said rim portion has been folded inwardly and is held in its inwards position by glueing, welding and/or a snap action.

Figure 2:
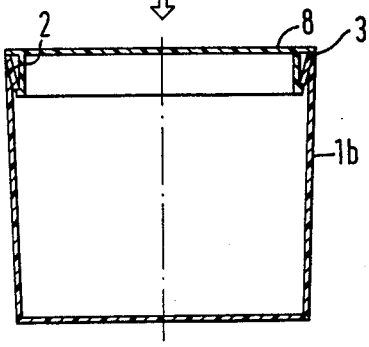
Figure 3:
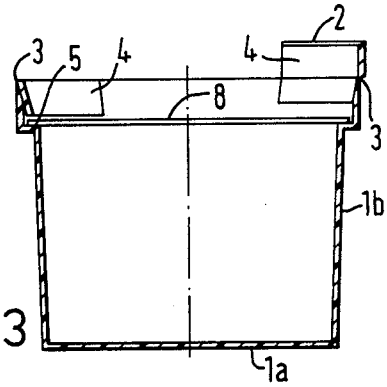
Figure 4:
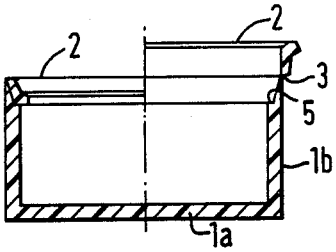
Figure 5:
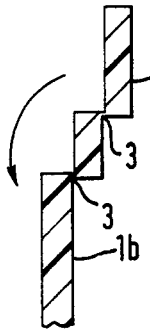
Figure 6:
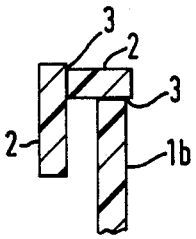
Figure 7:
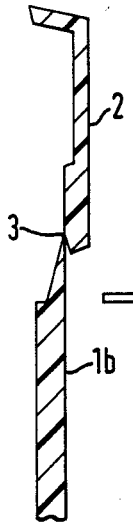
Figure 8:
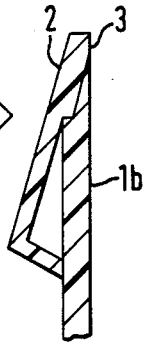
Figure 9:
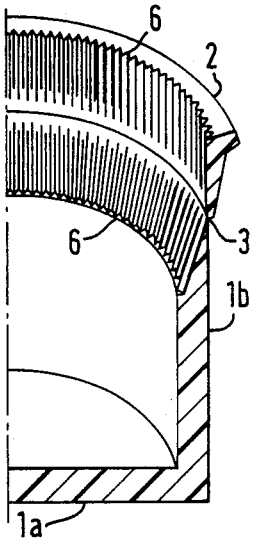
Figure 10:
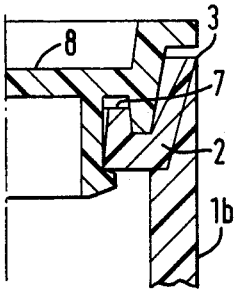

The following is a description, by way of example, of embodiments of the invention, reference being made to the accompanying schematic drawings, in which:

FIG. 1 is a sectional elevation of one embodiment as moulded,

FIG. 2 is a sectional elevation of the embodiment of FIG. 1 with the rim portion folded inwardly and a lid applied, FIG. 3 is a sectional elevation of a second embodiment, FIG. 4 is a sectional elevation of a third embodiment, FIG. 5 is a detail of a fourth embodiment with two rim portions, as moulded, FIG. 6 is a view corresponding to FIG. 5 after folding the rim portions inwardly, FIG. 7 is a detail of a fifth embodiment as moulded, FIG. 8 is a view corresponding to FIG. 7 after folding, FIG. 9 is a part-sectional and part-perspective view of a sixth embodiment, FIG. 10 is a detail of a seventh embodiment after folding, FIG. 11 is a detail of a seventh embodiment before applying a lid, FIG. 12 is a view corresponding to FIG. 11 after applying the lid, FIG. 13 is a perspective view of an eighth embodiment, FIGS. 14 and 15 are details of the embodiment of FIG. 13, FIG. 16 is a perspective view of a ninth embodiment, FIG. 17 is a detail of the embodiment of FIG. 16, FIG. 18 is a detail of a tenth embodiment with a lid in one closure position, and FIG. 19 is a view corresponding to FIG. 18 with the lid in a second closure position.

In the description of the different embodiments, the same reference numerals will be used for similar parts. The container of each embodiment is formed with a base 1*a*, a side wall 1*b*, a rim portion 2 and a hinge portion 3 all moulded in one piece from plastics. As shown, the container is of circular cross-section, but other cross-sections may be used. Preferably, the plastics is polypropylene but other flexible, resilient plastics such as is used for moulded containers may be employed. The hinge portion 3 is substantially thinner than the side wall 1*b* and the rim portion 2. No collapsible core is needed for injection moulding the container, as there is sufficient draw.

The container of FIG. 1 is shown in its form as moulded. After moulding, the rim 2 is folded inwardly and downwardly in the direction of the arrows into the position of FIG. 2 and remains held securely in this position as a result of the forces caused by the folding operation. The same general principle is used in the other embodiments. FIG. 2 shows a lid 8 applied to the container. The rim portion 2 and hinge portion 3 of FIGS. 1 and 2 extend continuously for the whole way round the container.

The container of FIG. 3 has a plurality of rim portions 2 in the form of segments 4 spaced apart round the container. The right-hand side of FIG. 3 shows a segment 4 in its position as moulded while the left-hand side shows a segment 4 in folded position. The inside of the side wall 1 is formed with an annular recess having an upwardly directed face 5 on which bears a lid 8 which, in the simplest form, may consist of a disc of cardboard. The lid is applied before folding in the segments 4 which, when folded in, act as a lock for the lid.

The container of FIG. 4 is similar in construction to that of FIG. 3 and similarly illustrated, but the rim portion 2 is continuous and, when folded in as shown on the left of the Figure, rests on the face 5 to avoid any risk of the hinge breaking when subsequently lidding the container.

FIGS. 5 and 6 show a double-hinged rim portion in the "as-moulded" position and the inwardly-folded position respectively.

FIGS. 7 and 8 show, in the "as-moulded" position and the inwardly-folded position respectively, an embodiment in which the hinge portion 3 is protected from damage by being disposed below the top of the container. A recess and supporting face are provided, as in FIG. 4, to relieve load on the hinge. The rim portion 2 also has an extension which is generally L-shaped in section and of which the extremity bears against the inside of the side wall 1*b* as shown in FIG. 8 to reduce risk of the folded rim portion becoming wavy.

FIG. 9 shows an embodiment in the "as-moulded" position having complementary axially-extending ribs 6 on the rim portion 2 and the inside of the side wall 1*b*. When the rim portion is folded inwardly, the ribs mesh to increase the stiffness of the container by preventing relative movement of the rim portion and side wall.

FIG. 10 shows an embodiment in the inwardly-folded position having a rim portion 2 with one or more upwardly-projecting projections or ribs 7 which co-operate with a corresponding projection or projections on the lid 8 to prevent the lid from penetrating too far into the container.

FIGS. 11 and 12 show an embodiment of container with lid in positions respectively before and after application. As shown in FIG. 12, when the lid 8 has been applied the lid and the rim portion 2 engage each other along a sealing line 9 and a bearing line 10. The distance between the two lines on the rim portion is greater than the corresponding distance on the lid before application. The lid has a peripheral flange which is inclined down at an angle $\alpha$ before application. On application, the resilience of the lid material allows the flange to distort upwards to that the lid can be closed and causes the closed lid to be held in tension between the sealing line and the bearing line.

The container of FIGS. 13–15 has a lid 8 with a recess 11 and a hand lever 12 for opening. A screw-driver or like tool can be inserted in the recess 11 and twisted to open the lid.

FIGS. 16 and 17 show a container with a pilfer-evident closure. A lid 8 is applied to the container and then the rim portion 2 is folded inwardly to snap over a ledge on top of the lid. In order to remove the lid, it is necessary to break part of the hinge portion 3 and peel off the rim portion.

FIGS. 18 and 19 show a container having a lid incorporating two snap beads 13. The lower bead protrudes at d for a smaller distance than the upper bead at D and therefore has a softer action. When the lid is pressed down so that only the lower bead is engaged, it can be easily removed by a thumb-up action. When the lid is pressed right down so that the upper bead is engaged, more strength or a tool is required to remove the lid. By choosing suitable dimensions, children would be able to open the lid only if the lower bead is engaged. The arrangement might also provide a useful safeguard in containers for drugs and dangerous products. The arrangement also provides an easyopening user position and a secure transport position.

The embodiments shown in the drawings have circular tops and have been described as relying on forces caused by the inwards folding of the rim portion or portions to hold the latter in the inwards position. In other embodiments, the rim portion or portions may additionally or alternatively be held in the inwards position by securing means such as glueing, welding and/or a snap action. Such securing means may be necessary where the rim portion is straight, as in a container with a rectangular top.

I claim:

1. A container made of flexible resilient plastics, said container comprising:

a sidewall;

a rim portion on said sidewall;

a hinged portion joining said rim portion and said sidewall, said hinge portion being of substantially less thickness than said rim portion and said sidewall; said sidewall, rim portion and hinge portion being molded in one piece and so formed that said rim portion can be folded inwardly and held in a position bearing against an inside of said sidewall, said rim portion when folded inwardly projecting inwards from said sidewall.

2. A container according to claim 1, wherein said sidewall, rim portion and hinge portion are inwardly concave, whereby when said rim portion is folded inwardly it is held in a position bearing against the inside of said sidewall by opposing forces in said rim portion and sidewall caused by folding.

3. A plastics container according to claim 2 wherein the rim portion extends continuously around the container.

4. A plastics container according to claim 2 wherein there are provided a plurality of rim portions spaced apart from one another around the container.

5. A plastics container according to claim 2 wherein at least two co-extensive rim portions are provided connected to each other by an integral hinge portion whereby the co-extensive rim portions can be folded inwardly of the container.

6. A plastics container according to claim 2 wherein the rim portion is shaped for releasably securing a lid on the container.

7. A plastics container according to claim 2 wherein said side wall has an internal recess for supporting said rim portion when folded inwardly.

8. A plastics container according to claim 2 wherein said side wall has an internal recess so formed that when the rim portion is folded inwardly there is a clearance between the rim portion and an upwardly-directed surface of the recess for accommodating a lid.

9. A plastics container according to claim 2 wherein said rim portion and the inside of said side wall are provided with complementary profiled formations which intermesh when the rim portion is folded inwardly.

10. A plastics container according to claim 2 wherein said rim portion has at least one projection which extends upwardly when the rim portion is folded inwardly.

11. A plastics container according to claim 2 having a lid, the lid and said rim portion being so formed that when the rim portion is folded inwardly and the lid is applied the lid and container engage each other at two axially spaced positions, the distance between the engagement positions on the container being greater than the distance between the engagement positions on the lid before the latter is applied, whereby after the lid has been applied it is axially tensioned.

12. A plastics container according to claim 2 having a lid, at least one of the container and the lid having at least one recess or projection for opening.

13. A plastics container according to claim 2 having a lid, the rim portion and lid being so formed that the inwardly-folded rim portion is locked in position by the lid, whereby the rim portion has to be peeled off along said hinge portion to permit removal of the lid.

14. A plastics container according to claim 2 having a lid, wherein one of the lid and the container has two axially spaced snap beads of different sizes.

15. A plastics container according to claim 2 wherein said rim portion has been folded inwards and is held in its inwards position by forces caused by folding.

16. A plastics container according to claim 1 wherein said rim portion has been folded inwardly and is held in its inwards position by securing means.

* * * * *